United States Patent [19]

Arimitsu

[11] Patent Number: 4,554,067

[45] Date of Patent: Nov. 19, 1985

[54] SEED TREATING MACHINE

[75] Inventor: Yoshiro Arimitsu, Lompoc, Calif.

[73] Assignee: John Bodger & Sons Co., El Monte, Calif.

[21] Appl. No.: 703,084

[22] Filed: Feb. 19, 1985

Related U.S. Application Data

[63] Continuation of Ser. No. 560,127, Dec. 12, 1983, abandoned.

[51] Int. Cl.[4] ..... B07B 4/00

[52] U.S. Cl. ..... 209/136; 209/138; 209/154; 209/477

[58] Field of Search ..... 56/126; 130/27 DF, 27 Z; 209/133-138, 154, 346, 141, 437, 474-477, 457

[56] References Cited

U.S. PATENT DOCUMENTS

| | | | |
|---|---|---|---|
| 540,441 | 6/1895 | Hewitt | 209/12 |
| 750,366 | 1/1904 | Iahraus | 209/476 |
| 2,931,500 | 4/1960 | Andren et al. | 209/138 |
| 3,269,532 | 8/1966 | Moore | 209/135 |
| 4,431,530 | 2/1984 | Syben | 209/138 |

FOREIGN PATENT DOCUMENTS

| | | | |
|---|---|---|---|
| 0022476 | 5/1948 | Finland | 209/437 |
| 0623581 | 7/1978 | U.S.S.R. | 209/477 |

*Primary Examiner*—Charles Hart

*Attorney, Agent, or Firm*—Fulwider, Patton, Rieber, Lee & Utecht

[57] ABSTRACT

A seed treating machine for the separation of seeds from lighter-weight particulant plant matter intermixed with the seeds. The seed separating machine includes a horizontally mounted table having a center opening under which a plurality of fans are mounted to provide an upward blast of air. A screen is affixed to the table over the center opening and a harvested mixture such as seeds and particulant plant matter are placed on top of the screen. The blast of air lifts the lighter particulant matter away from the heavier-weight seeds. A semicircular cover is affixed to the table covering the screen to contain the seeds. The lighter-weight material is released to the atmosphere. The table is pivotally mounted upon an upright stand, permitting the table to be tilted from side-to-side to fully expose the mixture to the air blast. The separated seeds roll down the table through a chute and into a container for packaging.

3 Claims, 3 Drawing Figures

SEED TREATING MACHINE

This is a continuation of application Ser. No. 560,127, filed Dec. 12, 1983 and now abandoned.

BACKGROUND OF THE INVENTION

1. Field of the Invention

The seed treating machine of the present invention relates generally to devices which separate mixtures composed of relatively heavy and lighter-weight elements.

2. Description of the Prior Art

In the field of harvesting seeds and marketing them on a large scale, it is desirable to have a machine which will separate the seeds from the husks, sepals, stems and other particulant matter which is inevitably accumulated in harvesting.

Prior devices to generate and direct air currents through a foranimous floor have been proposed, however, such devices were overly complex and ill-suited to the separating of seeds from particulant matter on a large scale. Other previous devices specifically directed to the separation of harvested seeds from particulant plant matter were also overly complex and required separators to produce vibrations. Such devices were directed to assembly line rather than batch processing.

In Bochan U.S. Pat. No. 3,050,869, a drying machine is disclosed wherein a fan blows air past heating coils and through a foranimous floor for drying articles placed on the floor. The flexible floor of the drying machine is cyclically and rapidly deformed, which causes articles resting on the floor to snap or bounce up. The device is operated by an electrical motor, is not manually operable, and uses large amounts of energy in the form of electricity for the heating coils rather than utilizing the efficient direction of air currents. The device will not function to separate elements of a dry mixture.

In McLeese U.S. Pat. No. 3,425,237, a complex agitation movement is generated by an electric motor for moving items of food along a conveyor as frozen air is directed underneath the food through a foranimous floor. No prior device known to applicant separates components of a mixture utilizing a conventional fan and means for thereafter capturing the separated components.

SUMMARY OF THE INVENTION

Accordingly, it is an object of the present invention to provide a seed treating machine which may be operated manually and requires little energy to operate, but which efficiently provides a blast of air directly to a mixture of plant matter that includes seeds sufficient to blow the lighter components of the mixture upward, out of the mixture into the atmosphere, leaving the seeds for packaging.

It is a further object of the present invention to provide a seed treating machine of the aforedescribed nature having means to optimize the location of the fans which produce the air blast, and minimize the resistance met by the air currents produced by such fans. More particularly, a rectangular table is horizontally and medially mounted by pivot pins on each side of the table to an upright stand which permits tilting movement of the table around the pivot pins. The table has a screened opening through which the blast of air passes. One end of the table is raised while the opposite end is lowered, creating an inclined plane whereby the force of gravity is utilized is agitate the mixture as it moves over the opening to thereby separate the seeds from the lighter-weight ingredients of the mixture. The air blast is generated by a plurality of fans which are vertically stacked directly underneath the opening in the table. A cover encloses the space above the screen to direct the lighter-weight elements into the atmosphere while containing the seeds. The seeds roll down the length of the table through a discharge chute.

DESCRIPTION OF THE PREFERRED EMBODIMENT

Figure 1:
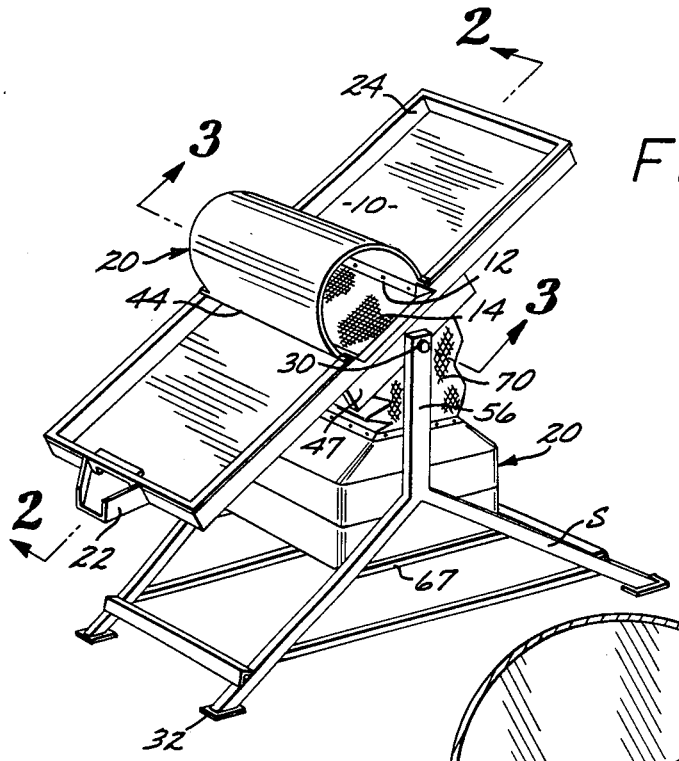
FIG. 1 is a perspective view of a preferred form of seed treating machine embodying the present invention.

Referring to the drawings, and particularly to FIG. 1, there is shown a preferred form of seed treating machine embodying the present invention. The seed treating machine is used to separate components of a mixture which has components of varying relative weights, such as seeds contained in a mixture that includes dried plant matter as petals, sepals, and stems. Such machine includes a stand S which pivotally supports a table 10 for horizontally rocking movement. Table 10 is centrally formed with a rectangular opening 12 covered by a screen 14. Fans F in housing member 20 generate an upwardly directed blast of air through screen 14 and hence through the seed-containing mixture. A cover 20 spaced above table 10 captures the ingredients of the mixture, with the lighter-weight ingredients flowing through the open front end of the cover into the atmosphere. The seeds will roll downwardly along the table to a discharge chute 22 formed at one end of the table.

More particularly, table 10 is of rectangular configuration and is provided with an upstanding peripheral wall 24. The left end of such wall is formed with an opening 26 in communication with discharge chute 22. Screen 14 is fitted and bolted to the table over opening 12 by a plurality of spaced fasteners 28. The screen 16 may be of varying-sized mesh, as best suited to the size of the components of the particular mixture which is to be separated. The table 10 is horizontally and medially mounted on two sides by pivot pins 30 to the top of stand S. Stand S is of inverted Y-shaped configuration having foot pads 32 which rest upon the ground.

Figure 3:
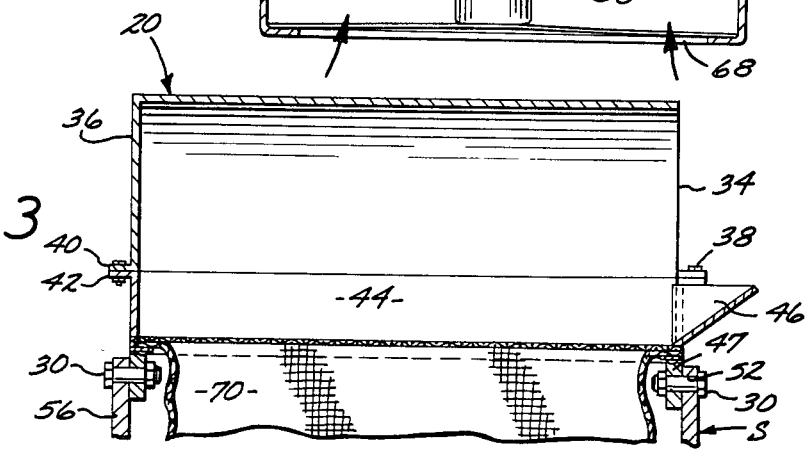
FIG. 3 is a transverse cross-sectional view taken in enlarged scale along lines 3—3 of FIG. 1.

Cover 20 is of arcuate vertical cross-section and is open at its front end to define an aperture 34. The rear of cover 20 is closed by a wall 36. The front and rear sides of cover 14 are secured to the upper edge of wall 24 by means bolt and nut fasteners 38 extending through complementary flanges 40 and 40, as shown particularly in FIG. 3. With continued reference to this figure, it will be noted a vertical space 44 is defined between the bottom of cover 14 and the upper surface of table 10. Note also an inlet chute 46 extends forwardly from the front mid-portion of wall 36.

The mid-portion of table 10 is provided with front and rear depending cross-braces 47 formed with bores 48 for receiving front and rear pivot pins 30. Such pivot pins extend through bores 52 formed in the upper ends of the vertical legs 56 of stand S.

The fans F shown in the drawings take the form of a pair of upper and lower conventional electric motor-driven, multiple-blade units 57 and 58 disposed within upper and lower, vertically stacked, interconnected enclosures 64 and 66, respectively, of housing member 20. The lower enclosure 66 is mounted upon stand S by cross-pieces 67 and has a bottom air inlet 68. It should be understood that although two fans are disclosed, a single fan or a plurality of fans greater than two may be employed. Such fans and their enclosures are co-axially stacked below the center line of table 10. An upwardly tapered collar 69 is secured to the top of the upper housing 64. A flexible bellows 70 formed of a suitable rubber-like material is interposed between the upper portion of collar 69 and the underside of table 10 just outwardly of opening 12 to direct the upwardly moving air flow generated by the fans F through screen 16. It should be understood that the magnitude of the air blast generated by fans F may be controlled by activating or deactivating the individual fan units and for varying the speeds of the fans. For example, the lowest magnitude would be provided when only one fan unit is activated at a "low" speed. The greatest magnitude would be provided when each fan unit is activated at a "high" speed. The magnitude of the air flow is pre-selected to accommodate the particular type of mixture which is to be separated.

Figure 2:
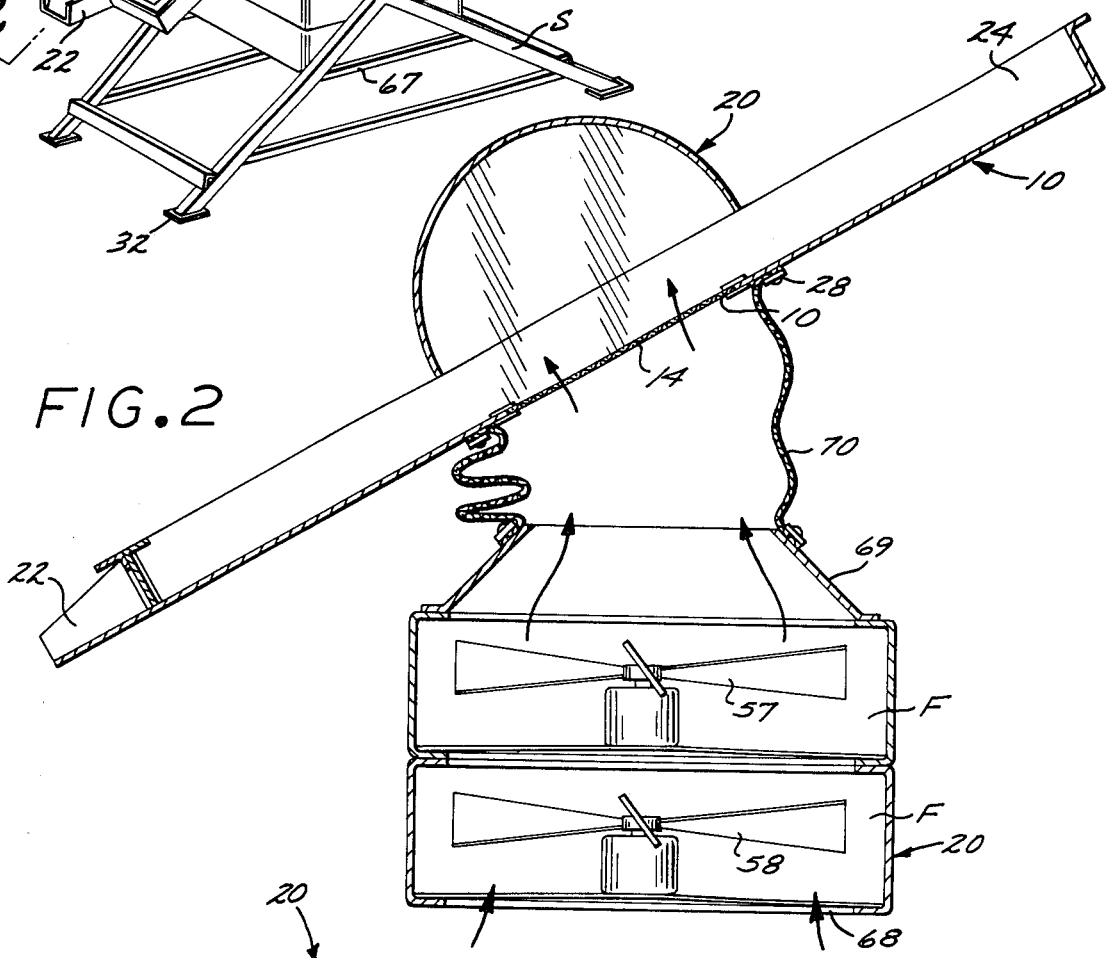
FIG. 2 is a longitudinal cross-sectional view taken in enlarged scale along lines 2—2 of FIG. 1.

In the operation of the aforedescribed seed treating machine, the mixture to be separated is dumped into the confines of cover 20 through inlet chute 46. As indicated by the directional arrows in FIG. 2, the upwardly directed movement of air generated by the fans F will lift the ingredients of the mixture off screen 14 and into the confines of cover 20. The cover will capture such ingredients, with the lighter-weight ingredients passing into the atmosphere through cover aperture 34. Meanwhile, the cover 20 will stop any seeds which are lifted off screen 14, and such seeds will drop back onto the table. The separation process is expedited by manually rocking the table 10 so as to more thoroughly expose the ingredients of the mixture to the air flowing upwardly through screen 14. The seeds deposited on the table will roll downwardly along the table through discharge chute 22 when the table is tilted to depress such chute, as indicated in FIG. 2.

Various modifications and changes may be made with respect to the foregoing detailed description without departing from the spirit of the present invention.

I claim:

1. A seed treating machine for separating seeds from the lighter ingredients of a mixture of plant matter that includes said seeds, said machine comprising:

a horizontally pivotable table centrally formed with an opening, and provided with a peripheral wall, with a discharge chute for the seeds beig formed in said wall at one end of the table;

a screen over said opening;

power-operated fan means for directing an air blast upwardly through said opening;

an open-sided cover over said opening, the bottom of said cover being spaced above said table; and whereby when said plant matter is deposited on said table over said screen and the table is rocked, the cover contains the ingredients of the mixture as they are lifted by said air blast through the opening in said table, the seeds falling onto the table for removal therefrom as the lighter ingredients are blown into the atmosphere out of the open side of the cover.

2. A seed treating machine as set forth in claim 1 wherein said table is pivotally supported by a stand and said air blast is provided by means mounted upon said stand below said table.

3. A seed treating machine as set forth in claim 1 wherein the velocity of said air blast may be varied.

* * * * *